US010157570B2

(12) United States Patent
Hung et al.

(10) Patent No.: US 10,157,570 B2
(45) Date of Patent: Dec. 18, 2018

(54) PIXEL CIRCUIT AND DRIVING METHOD THEREOF

(71) Applicant: AU OPTRONICS CORPORATION, Hsin-chu (TW)

(72) Inventors: Sen-Chuan Hung, Hsin-chu (TW); Chun-Yen Liu, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 156 days.

(21) Appl. No.: 15/151,997

(22) Filed: May 11, 2016

(65) Prior Publication Data

US 2016/0335954 A1 Nov. 17, 2016

(30) Foreign Application Priority Data

May 15, 2015 (TW) ..... 104115672 A

(51) Int. Cl.
*G09G 3/3258* (2016.01)
*G09G 3/3233* (2016.01)

(52) U.S. Cl.
CPC ... *G09G 3/3233* (2013.01); *G09G 2300/0852* (2013.01); *G09G 2300/0861* (2013.01); *G09G 2310/0251* (2013.01); *G09G 2320/0238* (2013.01)

(58) Field of Classification Search
CPC combination set(s) only.
See application file for complete search history.

(56) References Cited

U.S. PATENT DOCUMENTS 9,214,506 B2 * 12/2015 Xie ..... H01L 27/3265
9,343,014 B2 5/2016 Huang et al.
(Continued)

FOREIGN PATENT DOCUMENTS

CN 102054436 A 5/2011
CN 104464636 A 3/2015
TW 201131545 A 9/2011

OTHER PUBLICATIONS

Office Action issued by the State Intellectual Property Office of the Peoples Republic of China dated Jan. 26, 2017 for CN 201510441964.4.

*Primary Examiner* — Jennifer Mehmood
*Assistant Examiner* — Deeprose Subedi
(74) *Attorney, Agent, or Firm* — Tim Tingkang Xia, Esq.; Locke Lord LLP

(57) ABSTRACT

A pixel circuit includes a driving unit, a light emitting unit having a second terminal receiving a second voltage, a compensation capacitor, and first, second and third switches. The first switch has a first terminal connected to the driving unit, and a control terminal for receiving a first control signal. The second switch has a first terminal coupled to the second terminal of the first switch, a second terminal for receiving an initialization signal, and a control terminal for receiving the first control signal. The compensation capacitor has a first terminal coupled to the second terminal of the first switch, and a second terminal coupled to the first terminal of the light emitting unit. The third switch has a first terminal connected to the driving unit, a second terminal coupled to the first terminal of the light emitting unit, and a control terminal for receiving a light emission control signal.

15 Claims, 5 Drawing Sheets

(56) References Cited

U.S. PATENT DOCUMENTS

| | | | | |
|---|---|---|---|---|
| 2004/0179005 | A1* | 9/2004 | Jo | G09G 3/325 345/211 |
| 2010/0201674 | A1* | 8/2010 | Kim | G09G 3/3233 345/211 |
| 2014/0225878 | A1 | 8/2014 | Shih et al. | |
| 2016/0321990 | A1* | 11/2016 | Kim | G09G 3/3233 |

* cited by examiner

PIXEL CIRCUIT AND DRIVING METHOD THEREOF

CROSS-REFERENCE TO RELATED APPLICATIONS

This non-provisional application claims priority under 35 U.S.C. § 119(a) on Patent Application No. 104115672 filed in Taiwan, R.O.C. on May 15, 2015, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates generally to a pixel circuit, and in particular, to a pixel circuit of a light emitting diode.

BACKGROUND OF THE INVENTION

Currently, using a light emitting diode (LED) or an organic light emitting diode (OLED) as a medium of display has been a very common application. When the LED is in a dark state, the screen can be completely turned off by cutting off the current; therefore, compared with a conventional display, the LED has advantageous characteristics of power saving and high contrast. However, the LED element also has a parasitic resistance and a parasitic compensation capacitance, and when the path through which the current flows is cut off, there are residual charges in the LED element, which cause the LED element to emit light. In a dark environment, the light emission is rather obvious, greatly reducing the advantageous characteristics of high contrast and power saving of the LED panel.

Therefore, the problem of reduced contrast and increased power consumption due to residual charges is an urgent issue to be resolved in the industry.

SUMMARY OF THE INVENTION

In one aspect, the present invention relates to a pixel circuit that improves the contrast, thereby bringing a better viewing effect to users.

In certain embodiments, a pixel circuit includes a driving unit, a light emitting unit, a first switch, a second switch, a compensation capacitor, and a third switch. The light emitting unit has a first terminal, and a second terminal configured to receive a second voltage. The first switch has a first terminal electrically connected to the driving unit, a second terminal, and a control terminal configured to receive a first control signal. The second switch has a first terminal coupled to the second terminal of the first switch, a second terminal configured to receive an initialization signal, and a control terminal configured to receive the first control signal. The compensation capacitor has a first terminal coupled to the second terminal of the first switch, and a second terminal coupled to the first terminal of the light emitting unit. The third switch, having a first terminal electrically connected to the driving unit, a second terminal coupled to the first terminal of the light emitting unit, and a control terminal configured to receive a light emission control signal.

In certain embodiments, the driving unit includes a fourth switch, having a first terminal configured to receive a data signal, a control terminal configured to receive a second control signal, and a second terminal; a fifth switch, having a first terminal, a second terminal electrically connected to the first terminal of the third switch, and a control terminal configured to receive the second control signal; a sixth switch, having a first terminal electrically connected to the first terminal of the fourth switch, and a control terminal electrically connected to the first terminal of the fifth switch; a seventh switch, having a first terminal configured to receive a first voltage, a second terminal electrically connected to the first terminal of the sixth switch, and a control terminal configured to receive the light emission control signal; and a storage capacitor, having a first terminal configured to receive the first voltage, and a second terminal electrically connected to the first terminal of the fifth switch. In certain embodiments, each of the fourth switch, the fifth switch, the sixth switch, and the seventh switch is a transistor.

In certain embodiments, the driving unit includes a fourth switch, having a first terminal configured to receive a data signal, a control terminal configured to receive a second control signal, and a second terminal; a fifth switch, having a first terminal, a second terminal electrically connected to the first terminal of the third switch, and a control terminal configured to receive the second control signal; a sixth switch, having a first terminal electrically connected to the first terminal of the first switch, a second terminal, and a control terminal electrically connected to the first terminal of the fifth switch; a seventh switch, having a first terminal configured to receive a first voltage, a second terminal electrically connected to the second terminal of the fourth switch, and a control terminal configured to receive the light emission control signal; and a storage capacitor, having a first terminal electrically connected to the second terminal of the seventh switch, and a second terminal connected to the control terminal of the sixth switch. In certain embodiments, each of the fourth switch, the fifth switch, the sixth switch, and the seventh switch is a transistor.

In another aspect, the present inventions relates to a driving method applicable to a pixel circuit.

In certain embodiments, the pixel circuit includes a driving unit; a light emitting unit, having a first terminal and a second terminal configured to receive a second voltage; a first switch, having a first terminal electrically connected to the driving unit, a second terminal, and a control terminal configured to receive a first control signal; a second switch, having a first terminal coupled to the second terminal of the first switch, a second terminal configured to receive an initialization signal, and a control terminal configured to receive the first control signal; a compensation capacitor, having a first terminal and a second terminal, the first terminal being coupled to the second terminal of the first switch, and the second terminal being coupled to the first terminal of the light emitting unit; and a third switch, having a first terminal electrically connected to the driving unit, a second terminal coupled to the first terminal of the light emitting unit, and a control terminal configured to receive a light emission control signal. The driving method includes: in an initialization period, providing an initialization voltage so that a voltage at the second terminal of the compensation capacitor is less than a sum of the second voltage and a threshold voltage of the light emitting unit; in a compensation period, the driving unit receiving a data voltage; and in an emission period, the driving unit providing a driving current to the light emitting unit according to the received data voltage.

In certain embodiments, in the emission period, a voltage at the first terminal of the compensation capacitor is greater than the initialization voltage. In certain embodiments, each of the first switch, the second switch and the third switch is a transistor.

In certain embodiments, the driving unit includes a fourth switch, having a first terminal configured to receive a data signal, a control terminal configured to receive a second control signal, and a second terminal; a fifth switch, having a first terminal, a second terminal electrically connected to the first terminal of the third switch, and a control terminal configured to receive the second control signal; a sixth switch, having a first terminal electrically connected to the first terminal of the fourth switch, and a control terminal electrically connected to the first terminal of the fifth switch; a seventh switch, having a first terminal configured to receive a first voltage, a second terminal electrically connected to the first terminal of the sixth switch, and a control terminal configured to receive the light emission control signal; and a storage capacitor, having a first terminal configured to receive the first voltage, and a second terminal electrically connected to the first terminal of the fifth switch. In certain embodiments, each of the fourth switch, the fifth switch, the sixth switch, and the seventh switch is a transistor. In certain embodiments, the driving method further includes: in the initialization period, turning on the first switch and the second switch, and turning off the third switch, the fourth switch, the fifth switch and the seventh switch; in the compensation period, turning off the first switch, the second switch, the third switch and the seventh switch, and turning on the fourth switch and the fifth switch; and in the emission period, turning off the first switch, the second switch, the fourth switch and the fifth switch, and turning on the third switch and the seventh switch.

In certain embodiments, the driving unit includes a fourth switch, having a first terminal configured to receive a data signal, a control terminal configured to receive a second control signal, and a second terminal; a fifth switch, having a first terminal, a second terminal electrically connected to the first terminal of the third switch, and a control terminal configured to receive the second control signal; a sixth switch, having a first terminal electrically connected to the first terminal of the first switch, a second terminal, and a control terminal electrically connected to the first terminal of the fifth switch; a seventh switch, having a first terminal configured to receive a first voltage, a second terminal electrically connected to the second terminal of the fourth switch, and a control terminal configured to receive the light emission control signal; and a storage capacitor, having a first terminal electrically connected to the second terminal of the seventh switch, and a second terminal connected to the control terminal of the sixth switch. In certain embodiments, each of the fourth switch, the fifth switch, the sixth switch, and the seventh switch is a transistor. In certain embodiments, the driving method further comprises includes in the initialization period, turning on the first switch and the second switch, and turning off the third switch, the fourth switch, the fifth switch and the seventh switch; in the compensation period, turning off the first switch, the second switch, the third switch and the seventh switch, and turning on the fourth switch and the fifth switch; and in the emission period, turning off the first switch, the second switch, the fourth switch and the fifth switch, and turning on the third switch and the seventh switch.

The pixel circuit of this embodiment can inhibit the current flowing through the light emitting unit in the non-light emitting phase, and can reduce the leakage current flowing through the first switch in the light emitting phase, so that the pixel circuit can still keep a driving voltage in the case of long-term compensation, thereby maintaining the image quality.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

The detailed features and advantages of the present invention are described below in great detail through the following embodiments, and the content of the detailed description is sufficient for persons skilled in the art to understand the technical content of the present invention and to implement the present invention there accordingly. Based upon the content of the specification, the claims, and the drawings, persons skilled in the art can easily understand the relevant objectives and advantages of the present invention. The following embodiments further describe the viewpoints of the present invention, but are not intended to limit the scope of the present invention in any way.

As used herein, "electrically connected" may mean that two or more elements are either in direct physical or electrical contact, or that two or more elements are not in direct contact with each other but yet still co-operate or interact with each other.

The terms "first", "second" and the like as used herein are used for distinguishing between similar elements or operations and not necessarily for describing a sequence, either temporally, spatially, in ranking or in any other manner.

The terms "comprise", "include", "have" and "contain" as used herein are all open terms, that is, mean "including, but not limited to".

The term "and/or" as used herein includes any or all combinations of the objects described.

The directional terms "upper", "lower", "left", "right", "front", "back" and the like as used herein refer to the directions as seen in the accompanying drawings. Therefore, the directional terms as used herein are intended to illustrate rather than limit the present invention.

Unless otherwise specified, all the terms as used herein generally have the same meaning as is commonly understood by persons skilled in the art. Some terms used for describing the disclosure will be discussed below or in other parts of this specification, so as to provide additional guidance for persons skilled in the art in addition to the description of the disclosure.

Figure 1:
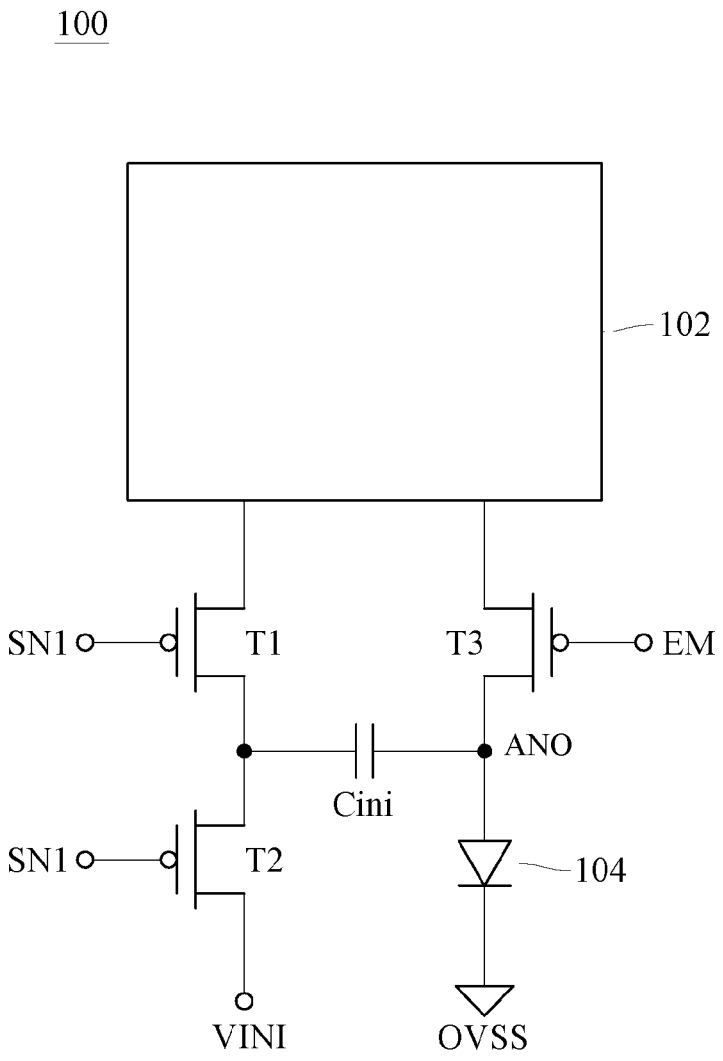
FIG. 1 is a schematic diagram of a pixel circuit according to an embodiment of the present invention.

FIG. 1 is a schematic diagram of a pixel circuit according to an embodiment of the present invention. Referring to FIG. 1, the pixel circuit 100 includes a driving unit 102, a light emitting unit 104, a first switch T1, a second switch T2, a third switch T3, and a compensation capacitor Cini. The light emitting unit 104 has a first terminal, and a second terminal configured to receive a second voltage OVSS. The first switch T1 has a first terminal, a second terminal and a control terminal. The first terminal of the first switch T1 is electrically connected to the driving unit 102, and the control terminal of the first switch T1 is configured to receive a first control signal SN1. The second switch T2 has a first terminal coupled to the second terminal of the first switch T1, a control terminal configured to receive the first control signal SN1, and a second terminal. The second terminal of the second switch T2 is configured to receive an initialization voltage VINI. The compensation capacitor Cini has a first terminal and a second terminal. The first terminal of the compensation capacitor Cini is coupled to the second terminal of the first switch T1, and the second terminal of the compensation capacitor is coupled to the first terminal of the light emitting unit 104. The third switch T3 has a first terminal, a second terminal and a control terminal. The first terminal of the third switch T3 is electrically connected to the driving unit 102, the second terminal of the third switch T3 is coupled to the first terminal of the light emitting unit 104, and the control terminal of the third switch T3 is configured to receive a light emission control signal EM. The switches of this embodiment may be implemented by using various elements having a switch function, such as field effect transistors, P-type transistors, and N-type transistors. The light emitting unit 104 of this embodiment may also be an organic LED or an inorganic LED. The compensation capacitor Cini of this embodiment may also be a storage element of another type, and the present invention is not limited thereto.

In certain embodiments, driving of the pixel circuit is divided into three phases: an initialization period, a compensation period, and an emission period. According to the embodiment shown in FIG. 1, when the pixel circuit 100 operates in the initialization phase, a voltage drop is generated when a voltage at the first terminal of the compensation capacitor Cini is pulled down from a data voltage to VINI. The voltage drop is coupled to the first terminal ANO of the light emitting unit 104 through the compensation capacitor Cini, so that the voltage at the first terminal ANO of the light emitting unit 104 is reduced to be less than (OVSS+Vth_104), where OVSS is a second voltage, and Vth_104 is a threshold voltage of the light emitting unit 104. By enabling a voltage difference between the first terminal and the second terminal of the light emitting unit 104 to be less than Vth_104, the current flowing through the light emitting unit 104 can be further inhibited, thereby eliminating the phenomenon that a black image is not black enough.

In certain embodiments, when the pixel circuit 100 of this embodiment operates in the emission phase, a boost voltage, via the voltage at the second terminal of the compensation capacitor Cini, is coupled to the voltage at the first terminal of the compensation capacitor Cini, so that the voltage at the first terminal of the compensation capacitor Cini is higher than the voltage Vini received in the initialization phase. This helps reduce the voltage difference between the first terminal and the second terminal of the first switch T1, and therefore reduce the leakage current flowing through the first switch T1, so that the pixel circuit 100 can still keep a driving voltage in the case of long-term compensation, thereby maintaining the image quality.

Figure 2:
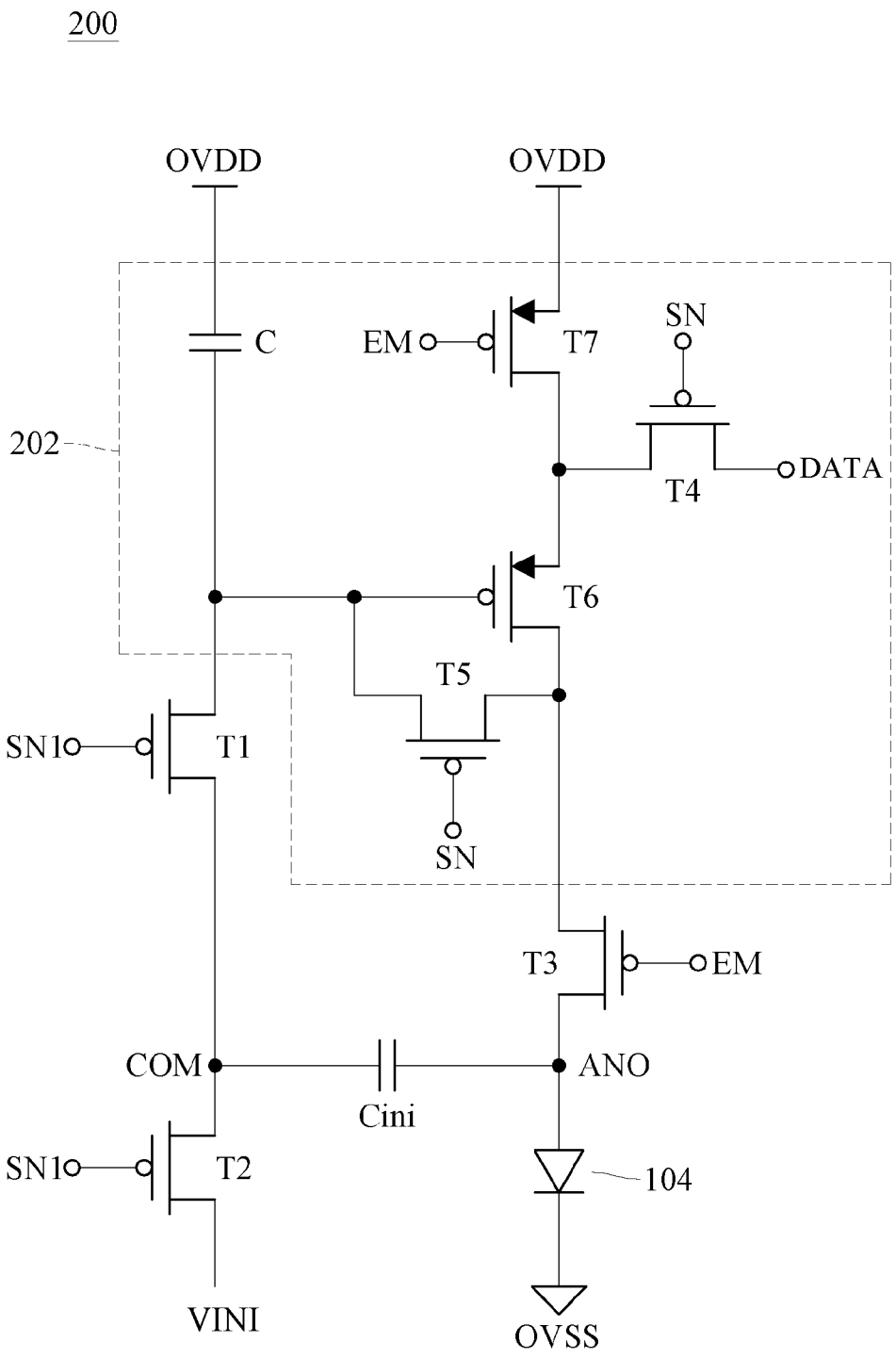
FIG. 2 is a schematic diagram of a pixel circuit according to an embodiment of the present invention.

FIG. 2 is a schematic diagram of a pixel circuit according to an embodiment of the present invention. Referring to FIG. 2, the pixel circuit 200 includes a driving unit 202, a light emitting unit 104, a first switch T1, a second switch T2, a third switch T3, and a compensation capacitor Cini. The light emitting unit 104 has a first terminal and a second terminal. The second terminal of the light emitting unit 104 is configured to receive a second voltage OVSS. The first switch T1 has a first terminal, a second terminal and a control terminal. The first terminal of the first switch T1 is electrically connected to the driving unit 202, and the control terminal of the first switch T1 is configured to receive a first control signal SN1. The second switch T2 has a first terminal coupled to the second terminal of first switch T1, a second terminal configured to receive an initialization signal VINI, and a control terminal configured to receive the first control signal SN1. The compensation capacitor Cini has a first terminal and a second terminal. The first terminal of the compensation capacitor Cini is coupled to the second terminal of the first switch T1, and the second terminal of the compensation terminal is coupled to the first terminal of the light emitting unit 104. The third switch T3 has a first terminal, a second terminal and a control terminal. The first terminal of the third switch T3 is electrically connected to the driving unit 202, the second terminal of the third switch T3 is coupled to the first terminal of the light emitting unit 104, and the control terminal of the third switch T3 is configured to receive a light emission control signal EM.

The driving unit 202 includes a fourth switch T4, a fifth switch T5, a sixth switch T6, a seventh switch T7, and a storage capacitor C. The fourth switch T4 has a first terminal configured to receive a data signal DATA, a control terminal configured to receive a second control signal SN, and a second terminal. The fifth switch T5 has a first terminal, a second terminal electrically connected to the first terminal of the third switch T3, control terminal configured to receive the second control signal SN. The sixth switch T6 has a first terminal electrically connected to the first terminal of the fourth switch T4, a second terminal electrically connected to the second terminal of the fifth switch T5, and a control terminal electrically connected to the first terminal of the fifth switch T5. The seventh switch T7 has a first terminal configured to receive a first voltage OVDD, a second terminal electrically connected to the first terminal of the sixth switch T6, and a control terminal configured to receive the light emission control signal EM. The storage capacitor C has a first terminal configured to receive the first voltage OVDD and a second terminal electrically connected to the first terminal of the fifth switch T5.

Figure 3:
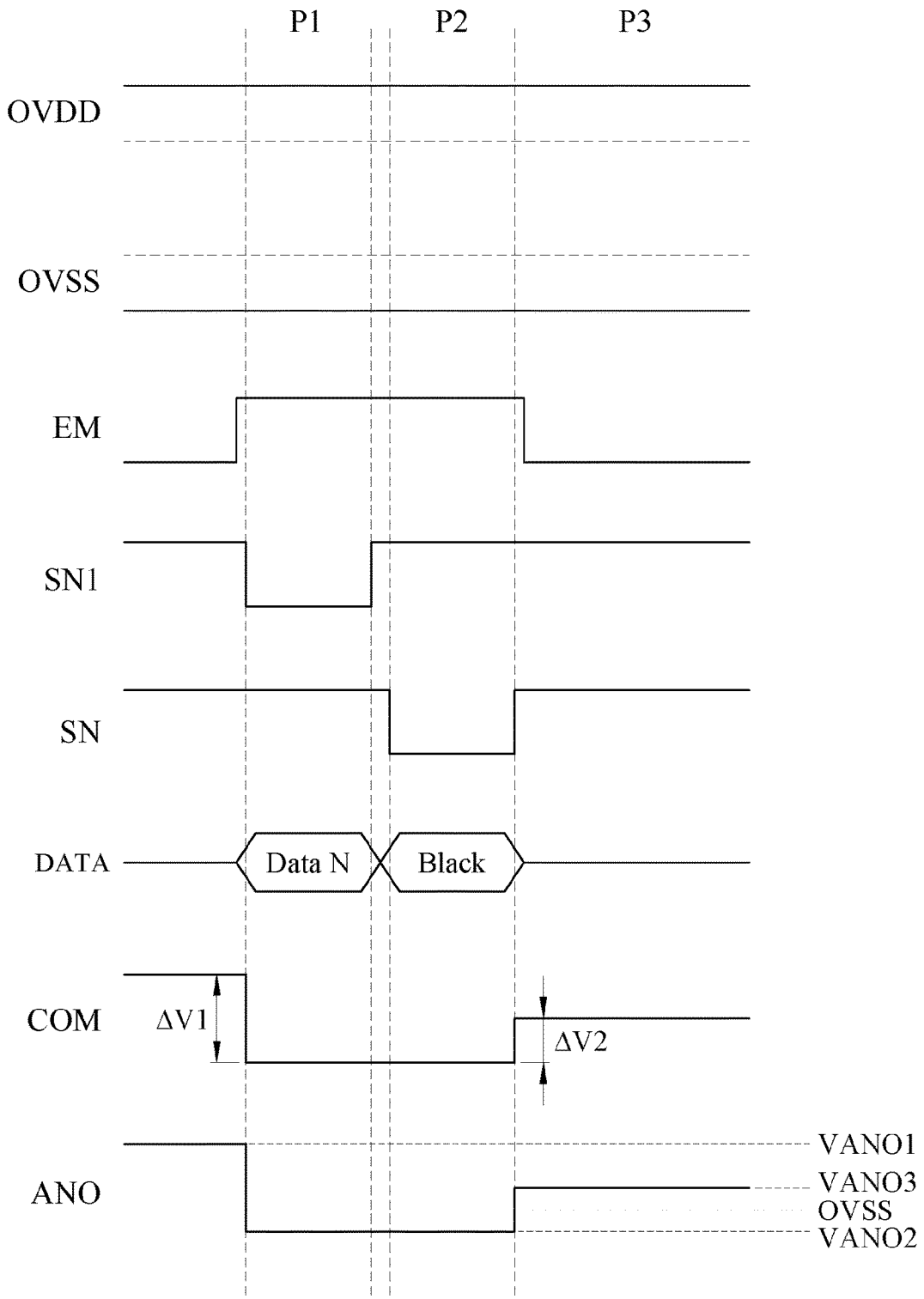
FIG. 3 illustrates a driving waveform of a pixel circuit according to an embodiment of the present invention.

FIG. 3 illustrates a driving waveform of a pixel circuit according to an embodiment of the present invention, where driving of the pixel circuit may be divided into three periods: an initialization period P1, a compensation period P2, and an emission period P3. OVDD is a first voltage, OVSS is a second voltage, OVDD is greater than OVSS, EM is a light emission control signal, SN1 is a first control signal, SN is a second control signal, DATA is a data signal, COM is the voltage at the first terminal of the compensation capacitor Cini, and ANO is the voltage at the first terminal of the light emitting unit 104.

Refer to FIGS. 2 and 3, in the initialization period P1, the first control signal SN1 is at a low level, and therefore, the first switch T1 and the second switch T2 are on; the second control signal SN is at a high level, and therefore, the fourth switch T4 and the fifth switch T5 are off; and the light emission control signal EM is at a high level, and therefore, the third switch T3 and the seventh switch T7 are off. In the initialization period P1, the initialization signal VINI is fed to the second terminal of the second switch T2, and in this case, the voltage at the control terminal of the sixth switch T6 and the voltage COM at the first terminal of the compensation capacitor Cini are equal to the initialization signal VINI. When the voltage COM at the first terminal of the compensation capacitor Cini drops by a voltage ΔV1, the voltage ANO at the second terminal of the compensation capacitor Cini is also coupled down under the action of the voltage COM at the first terminal of the compensation capacitor Cini, and in this case, the voltage ANO at the second terminal of the compensation capacitor Cini is (OVSS+Vth_104)−ΔV1, so that the voltage difference between the two terminals of the light emitting unit 104 is less than a threshold voltage of the light emitting unit 104, and the current flowing through the light emitting unit 104 can be further inhibited, thereby eliminating the phenomenon that a dark image is not dark enough.

In the compensation period P2, the first control signal SN1 is at a high level, and therefore, the first switch T1 and the second switch T2 are off; the second control signal SN is at a low level, and therefore, the fourth switch T4 and the fifth switch T5 are on; and the light emission control signal EM is at a high level, and therefore, the third switch T3 and the seventh switch T7 are off. In the compensation period P2, the data signal DATA is fed to the first terminal of the fourth switch T4, and in this case, the control terminal and the second terminal of the sixth switch T6 are conducted, and the voltage at the control terminal of the sixth switch T6 is Vdata−Vth_T6, where Vth_T6 is a threshold voltage of the sixth switch T6. In the compensation period P2, the voltage COM at the first terminal of the compensation capacitor Cini and the voltage ANO at the second terminal of the compensation capacitor Cini are still maintained at the same voltage levels as those in the initialization phase P1, and therefore, the current flowing through the light emitting unit 104 can still be inhibited and the phenomenon that a black image is not black enough can still be eliminated.

In the emission period P3, the first control signal SN1 is at a high level, and therefore, the first switch T1 and the second switch T2 are off; the second control signal SN is at a high level, and therefore, the fourth switch T4 and the fifth switch T5 are off; and the light emission control signal EM is at a low level, and therefore, the third switch T3 and the seventh switch T7 are on. Therefore, there is a current flowing through the light emitting unit 104 to cause the light emitting unit 104 to emit light. In the emission period P3, because the third switch T3 and the seventh switch T7 are on, the voltage ANO at the second terminal of the compensation capacitor Cini rises, and the voltage COM at the first terminal of the compensation capacitor Cini that is coupled to the voltage ANO also rises. In this way, the voltage difference between the first terminal and the second terminal of the first switch T1 is reduced, and therefore, the leakage current flowing through the first switch T1 is reduced, so that the pixel circuit 200 can still keep a driving voltage in the case of long-term compensation, thereby maintaining the image quality.

Figure 4:
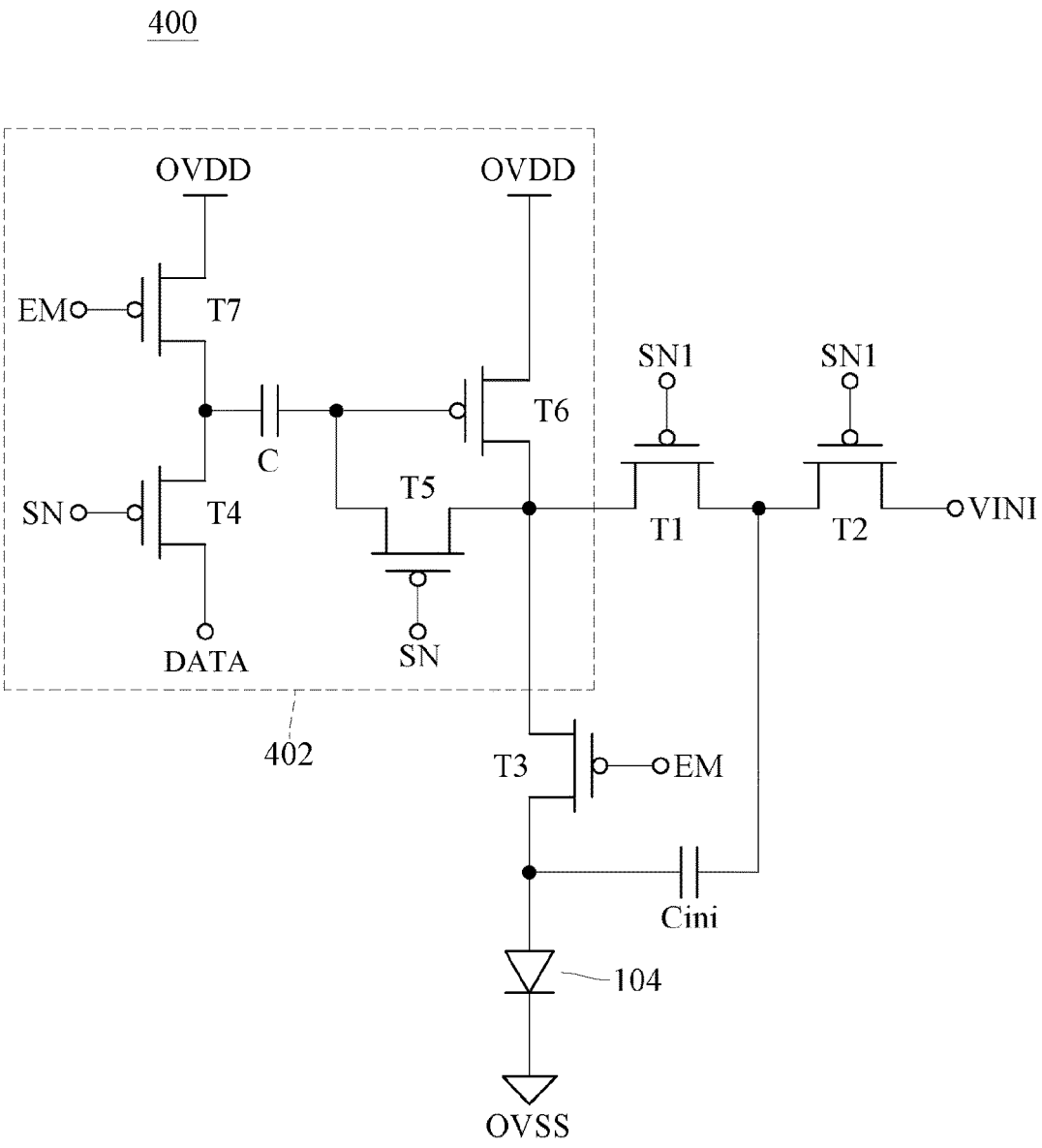
FIG. 4 is a schematic diagram of a pixel circuit according to another embodiment of the present invention.
Figure 5:
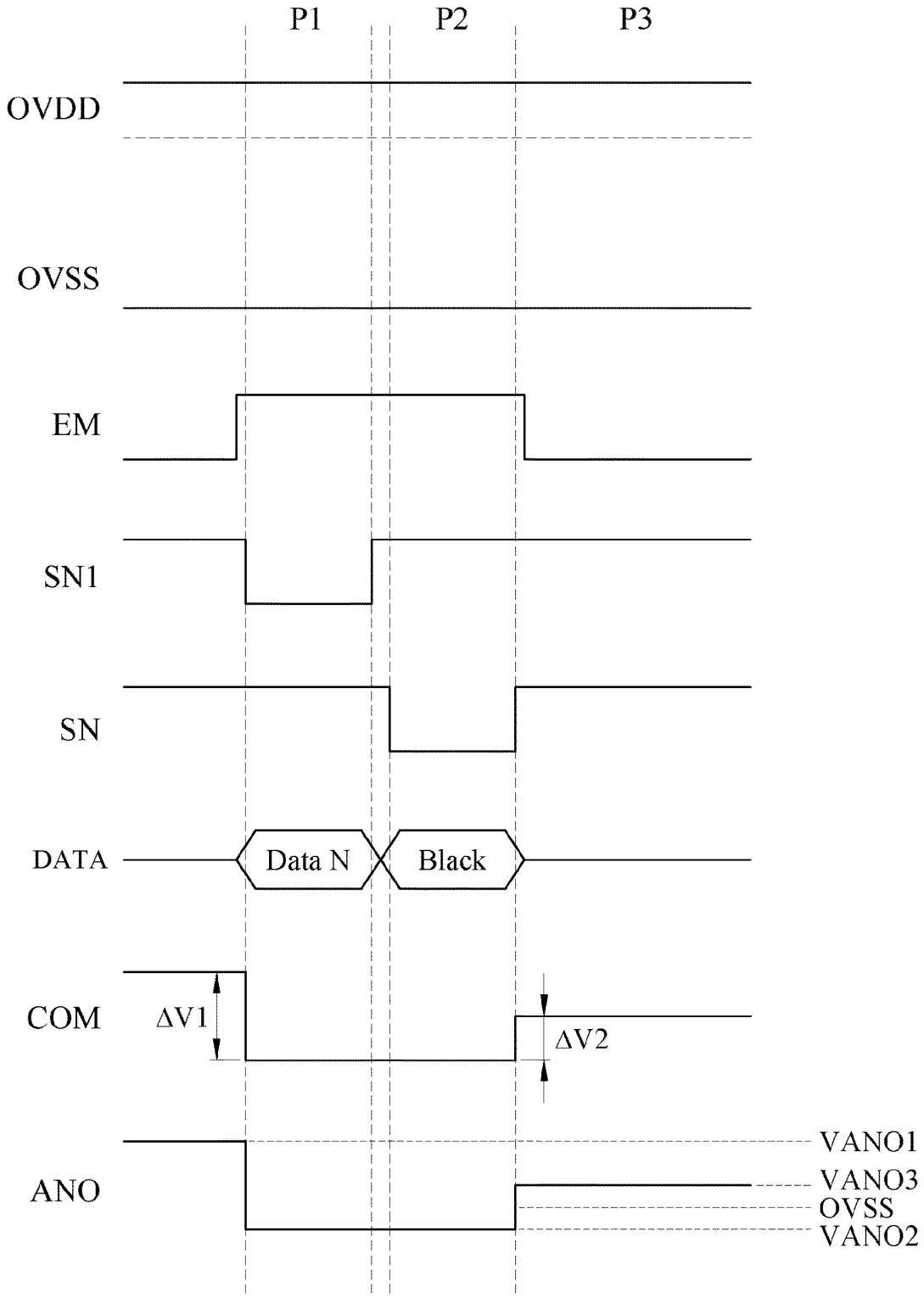
FIG. 5 illustrates a driving waveform of a pixel circuit according to an embodiment of the present invention.

FIG. 4 is a schematic diagram of a pixel circuit according to an embodiment of the present invention, and FIG. 5 illustrates a driving waveform of the pixel circuit of FIG. 4. Referring to FIG. 5, driving of the pixel circuit may be divided into three periods: an initialization period P1, a compensation period P2, and an emission period P3. OVDD is a first voltage (system high voltage), OVSS is a second voltage (system low voltage), EM is a light emission control signal, SN1 is a first control signal, SN is a second control signal, DATA is a data signal, COM is the voltage at the first terminal of the compensation capacitor Cini, and ANO is the voltage at the first terminal of the light emitting unit 104.

Referring back to FIG. 4, the pixel circuit 400 includes a driving unit 402, a light emitting unit 104, a first switch T1, a second switch T2, a third switch T3, and a compensation capacitor Cini. The light emitting unit 104 has a first terminal and a second terminal. The first switch T1 has a first terminal, a second terminal and a control terminal. The first terminal of the first switch T1 is electrically connected to the driving unit 402, and the control terminal of the first switch T1 is configured to receive a first control signal SN1. The second switch T2 has a first terminal coupled to the second terminal of the first switch T1, and a second terminal. The second terminal of the second switch T2 is configured to receive an initialization signal VINI. The compensation capacitor Cini has a first terminal and a second terminal. The first terminal of the compensation capacitor Cini is coupled to the second terminal of the first switch T1, and the second terminal of the compensation capacitor Cini is coupled to the first terminal of the light emitting unit 104. The third switch T3 has a first terminal, a second terminal and a control terminal. The first terminal of the third switch T3 is electrically connected to the driving unit 402, the second terminal of the third switch T3 is coupled to the first terminal of the light emitting unit 104, and the control terminal of the third switch T3 is configured to receive a light emission control signal EM. The driving unit 402 includes a fourth switch T4, a fifth switch T5, a sixth switch T6, a seventh switch T7, and a storage capacitor C. The fourth switch T4 has a first terminal configured to receive a data signal DATA, a control terminal configured to receive a second control signal SN, and a second terminal. The fifth switch T5 has a first terminal, a second terminal electrically connected to the first terminal of the third switch T3, and a control terminal configured to receive the second control signal SN. The sixth switch T6 has a first terminal configured to receive a first voltage OVDD, a control terminal electrically connected to the first terminal of the fifth switch T5, and a second terminal electrically connected to the second terminal of the fifth switch T5. The seventh switch T7 has a first terminal configured to receive the first voltage OVDD, a second terminal electrically connected to the first terminal of the fourth switch T4, and a control terminal configured to receive the light emission control signal EM. The storage capacitor C has a first terminal electrically connected to the second terminal of the seventh switch T7, and a second terminal electrically connected to the first terminal of the fifth switch T5.

Referring to FIGS. 4 and 5, in the initialization period P1, the first control signal SN1 is at a low level, and therefore, the first switch T1 and the second switch T2 are on; the second control signal SN is at a high level, and therefore, the fourth switch T4 and the fifth switch T5 are off; and the light emission control signal EM is at a high level, and therefore, the third switch T3 and the seventh switch T7 are off. In the initialization period P1, the initialization signal VINI is fed to the second terminal of the second switch T2, and in this case, the voltage at the control terminal of the sixth switch T6 and the voltage COM at the first terminal of the compensation capacitor Cini are equal to the initialization signal VINI. When the voltage COM at the first terminal of the compensation capacitor Cini drops by a voltage ΔV1, the voltage ANO at the second terminal of the compensation capacitor Cini is also coupled down under the action of the voltage COM at the first terminal of the compensation capacitor Cini, so that the voltage difference between the two terminals of the light emitting unit 104 is less than a threshold voltage of the light emitting unit 104, and the current flowing through the light emitting unit 104 can be further inhibited, thereby eliminating the phenomenon that a black image is not black enough.

In the compensation period P2, the first control signal SN1 is at a high level, and therefore, the first switch T1 and the second switch T2 are off; the second control signal SN is at a low level, and therefore, the fourth switch T4 and the fifth switch T5 are on; and the light emission control signal EM is at a high level, and therefore, the third switch T3 and the seventh switch T7 are off. In the compensation period P2, the data signal DATA is fed to the first terminal of the fourth switch T4, and in this case, the control terminal and the second terminal of the sixth switch T6 are conducted, and the voltage at the control terminal of the sixth switch T6 is OVDD−Vth_T6, where Vth_T6 is a threshold voltage of the sixth switch T6.

In the emission period P3, the first control signal SN1 is at a high level, and therefore, the first switch T1 and the second switch T2 are off; the second control signal SN is at a high level, and therefore, the fourth switch T4 and the fifth switch T5 are off; and the light emission control signal EM is at a low level, and therefore, the third switch T3 and the seventh switch T7 are on. Therefore, there is a current flowing through the light emitting unit 104 to cause the light emitting unit 104 to emit light. In the emission period P3, because the third switch T3 and the seventh switch T7 are on, the voltage ANO at the second terminal of the compensation capacitor Cini rises, and the voltage COM at the first terminal of the compensation capacitor Cini that is coupled to the voltage ANO also rises. In this way, the voltage difference between the first terminal and the second terminal of the first switch T1 is reduced, and therefore, the leakage current flowing through the first switch T1 is reduced, so that the pixel circuit 400 can still keep a driving voltage in the case of long-term compensation, thereby maintaining the image quality.

Based on the above, the pixel circuit of this embodiment can inhibit the current flowing through the light emitting unit in the non-light emitting phase, and can reduce the leakage current flowing through the first switch T1 in the light emitting phase, so that the pixel circuit can still keep a driving voltage in the case of long-term compensation, thereby maintaining the image quality The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A pixel circuit, comprising:

a driving unit;

a light emitting unit, having a first terminal, and a second terminal configured to receive a second voltage;

a first switch, having a first terminal electrically connected to the driving unit, a second terminal, and a control terminal configured to receive a first control signal;

a second switch, having a first terminal directly coupled to the second terminal of the first switch, a second terminal configured to receive an initialization signal, and a control terminal configured to receive the first control signal;

a compensation capacitor, having a first terminal directly coupled to the second terminal of the first switch, and a second terminal directly coupled to the first terminal of the light emitting unit; and a third switch, having a first terminal electrically connected to the driving unit, a second terminal directly coupled to the first terminal of the light emitting unit, and a control terminal configured to receive a light emission control signal.

2. The pixel circuit according to claim 1, wherein each of the first switch, the second switch, and the third switch is a transistor.

3. The pixel circuit according to claim 1, wherein the driving unit comprises:

a fourth switch, having a first terminal configured to receive a data signal, a control terminal configured to receive a second control signal, and a second terminal;

a fifth switch, having a first terminal, a second terminal electrically connected to the first terminal of the third switch, and a control terminal configured to receive the second control signal;

a sixth switch, having a first terminal electrically connected to the first terminal of the fourth switch, and a control terminal electrically connected to the first terminal of the fifth switch;

a seventh switch, having a first terminal configured to receive a first voltage, a second terminal electrically connected to the first terminal of the sixth switch, and a control terminal configured to receive the light emission control signal; and a storage capacitor, having a first terminal configured to receive the first voltage, and a second terminal electrically connected to the first terminal of the fifth switch.

4. The pixel circuit according to claim 3, wherein each of the fourth switch, the fifth switch, the sixth switch, and the seventh switch is a transistor.

5. The pixel circuit according to claim 1, wherein the driving unit comprises:

a fourth switch, having a first terminal configured to receive a data signal, a control terminal configured to receive a second control signal, and a second terminal;

a fifth switch, having a first terminal, a second terminal electrically connected to the first terminal of the third switch, and a control terminal configured to receive the second control signal;

a sixth switch, having a first terminal electrically connected to the first terminal of the first switch, a second terminal, and a control terminal electrically connected to the first terminal of the fifth switch;

a seventh switch, having a first terminal configured to receive a first voltage, a second terminal electrically connected to the second terminal of the fourth switch, and a control terminal configured to receive the light emission control signal; and a storage capacitor, having a first terminal electrically connected to the second terminal of the seventh switch, and a second terminal connected to the control terminal of the sixth switch.

6. The pixel circuit according to claim 5, wherein each of the fourth switch, the fifth switch, the sixth switch, and the seventh switch is a transistor.

7. A driving method, applicable to a pixel circuit, wherein the pixel circuit comprises:

a driving unit;

a light emitting unit, having a first terminal and a second terminal configured to receive a second voltage;

a first switch, having a first terminal electrically connected to the driving unit, a second terminal, and a control terminal configured to receive a first control signal;

a second switch, having a first terminal directly coupled to the second terminal of the first switch, a second terminal configured to receive an initialization signal, and a control terminal configured to receive the first control signal;

a compensation capacitor, having a first terminal and a second terminal, the first terminal being directly coupled to the second terminal of the first switch, and the second terminal being directly coupled to the first terminal of the light emitting unit; and a third switch, having a first terminal electrically connected to the driving unit, a second terminal directly coupled to the first terminal of the light emitting unit, and a control terminal configured to receive a light emission control signal; and wherein the driving method comprises:

in an initialization period, providing an initialization voltage so that a voltage at the second terminal of the compensation capacitor is less than a sum of the second voltage and a threshold voltage of the light emitting unit;

in a compensation period, the driving unit receiving a data voltage; and in an emission period, the driving unit providing a driving current to the light emitting unit according to the received data voltage.

8. The driving method according to claim 7, wherein in the emission period, a voltage at the first terminal of the compensation capacitor is greater than the initialization voltage.

9. The driving method according to claim 7, wherein each of the first switch, the second switch and the third switch is a transistor.

10. The driving method according to claim 7, wherein the driving unit comprises:

a fourth switch, having a first terminal configured to receive a data signal, a control terminal configured to receive a second control signal, and a second terminal;

a fifth switch, having a first terminal, a second terminal electrically connected to the first terminal of the third switch, and a control terminal configured to receive the second control signal;

a sixth switch, having a first terminal electrically connected to the first terminal of the fourth switch, and a control terminal electrically connected to the first terminal of the fifth switch;

a seventh switch, having a first terminal configured to receive a first voltage, a second terminal electrically connected to the first terminal of the sixth switch, and a control terminal configured to receive the light emission control signal; and a storage capacitor, having a first terminal configured to receive the first voltage, and a second terminal electrically connected to the first terminal of the fifth switch.

11. The driving method according to claim 10, wherein each of the fourth switch, the fifth switch, the sixth switch, and the seventh switch is a transistor.

12. The driving method according to claim 10, further comprising:

in the initialization period, turning on the first switch and the second switch, and turning off the third switch, the fourth switch, the fifth switch and the seventh switch;

in the compensation period, turning off the first switch, the second switch, the third switch and the seventh switch, and turning on the fourth switch and the fifth switch; and in the emission period, turning off the first switch, the second switch, the fourth switch and the fifth switch, and turning on the third switch and the seventh switch.

13. The driving method according to claim 7, wherein the driving unit comprises:

a fourth switch, having a first terminal configured to receive a data signal, a control terminal configured to receive a second control signal, and a second terminal;

a fifth switch, having a first terminal, a second terminal electrically connected to the first terminal of the third switch, and a control terminal configured to receive the second control signal;

a sixth switch, having a first terminal electrically connected to the first terminal of the first switch, a second terminal, and a control terminal electrically connected to the first terminal of the fifth switch;

a seventh switch, having a first terminal configured to receive a first voltage, a second terminal electrically connected to the second terminal of the fourth switch, and a control terminal configured to receive the light emission control signal; and a storage capacitor, having a first terminal electrically connected to the second terminal of the seventh switch, and a second terminal connected to the control terminal of the sixth switch.

14. The driving method according to claim 13, wherein each of the fourth switch, the fifth switch, the sixth switch, and the seventh switch is a transistor.

15. The driving method according to claim 13, further comprising:

in the initialization period, turning on the first switch and the second switch, and turning off the third switch, the fourth switch, the fifth switch and the seventh switch;

in the compensation period, turning off the first switch, the second switch, the third switch and the seventh switch, and turning on the fourth switch and the fifth switch; and in the emission period, turning off the first switch, the second switch, the fourth switch and the fifth switch, and turning on the third switch and the seventh switch.

* * * * *